US009176451B2

(12) United States Patent
Saiki

(10) Patent No.: US 9,176,451 B2
(45) Date of Patent: Nov. 3, 2015

(54) IMAGE FORMING APPARATUS, METHOD FOR CONTROLLING THE SAME, AND STORAGE MEDIUM

(71) Applicant: CANON KABUSHIKI KAISHA, Tokyo (JP)

(72) Inventor: Kenji Saiki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/472,219

(22) Filed: Aug. 28, 2014

(65) Prior Publication Data

US 2015/0063841 A1 Mar. 5, 2015

(30) Foreign Application Priority Data

Aug. 30, 2013 (JP) ..... 2013-180001

(51) Int. Cl.
*G03G 15/00* (2006.01)
*G03G 15/08* (2006.01)

(52) U.S. Cl.
CPC ..... *G03G 15/556* (2013.01); *G03G 15/0863* (2013.01)

(58) Field of Classification Search
None
See application file for complete search history.

(56) References Cited

U.S. PATENT DOCUMENTS

2014/0002537 A1 * 1/2014 Thacker et al. ..... 347/19

FOREIGN PATENT DOCUMENTS

JP 2006-343621 A 12/2006

* cited by examiner

*Primary Examiner* — Clayton E Laballe
*Assistant Examiner* — Jas Sanghera
(74) *Attorney, Agent, or Firm* — Canon USA Inc. IP Division

(57) ABSTRACT

An image forming apparatus executes control for predicting a toner remaining amount, if the apparatus can acquire a predetermined value as identification information indicating a type or a manufacture of a toner cartridge.

6 Claims, 8 Drawing Sheets

IMAGE FORMING APPARATUS, METHOD FOR CONTROLLING THE SAME, AND STORAGE MEDIUM

BACKGROUND OF THE INVENTION

1. Field of the Invention

The present invention relates to an image forming apparatus, a method for controlling the same, and a storage medium.

2. Description of the Related Art

An image forming apparatus forms an image on a sheet using a recording material such as a toner and so forth. In general, the recording material is stored in a storage unit such as a cartridge. Some image forming apparatuses detect an amount of the recoding material remaining in the storage unit and display the amount on a display unit such as a user interface (UI).

Up to now, a sensor has been provided, and a value detected by the sensor has been directly displayed as a remaining amount of the recoding material. A sensor which can accurately detect the remaining amount when the remaining amount lowers to a certain extent is often adopted in consideration of its cost. In this case, the sensor discretely detects the remaining amount of the recoding material, like 100%, 20%, and 10%, for example. As a result, the display unit also discretely displays the remaining amount of the recoding material, like 100%, 20%, and 10%, for example.

On the other hand, Japanese Patent Application Laid-Open No. 2006-343621 discusses a technique in which a display unit continuously displays the remaining amount of the recoding material while a sensor discretely detects the remaining amount. For example, when an image is formed, a predicted value of a toner remaining amount is calculated based on a dot count value of raster data, and the predicted value is displayed as a current value of the toner remaining amount. When a sensor value of the toner remaining amount is acquired from the sensor, the current value is updated by the sensor value.

Control for displaying the toner remaining amount by the current value requires predetermined information for setting an initial value of the toner remaining amount and calculating the predicted value of the toner remaining amount. The predetermined information is acquired from a memory tag of a toner cartridge.

However, the predetermined information may be incorrect or not be sometimes stored in the memory tag depending on a type or a manufacture of the toner cartridge. In such a case, the toner remaining amount may not be adequately displayed.

SUMMARY OF THE INVENTION

The present invention is directed to preventing a toner remaining amount from not being adequately displayed depending on a type or a manufacture of a toner cartridge.

According to an aspect of the present invention, an image forming apparatus for forming an image using a recording material includes a prediction unit configured to predict a remaining amount of the recording material based on data used in forming the image, a setting unit configured to set a remaining amount of the recording material to be displayed, an identification unit configured to identify a value indicating a type of a storage unit for storing the recording material, and a control unit configured to perform control, if the identification unit identifies a predetermined value, to set the remaining amount of the recording material predicted by the prediction unit as the remaining amount of the recording material to be displayed.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

Figure 1:
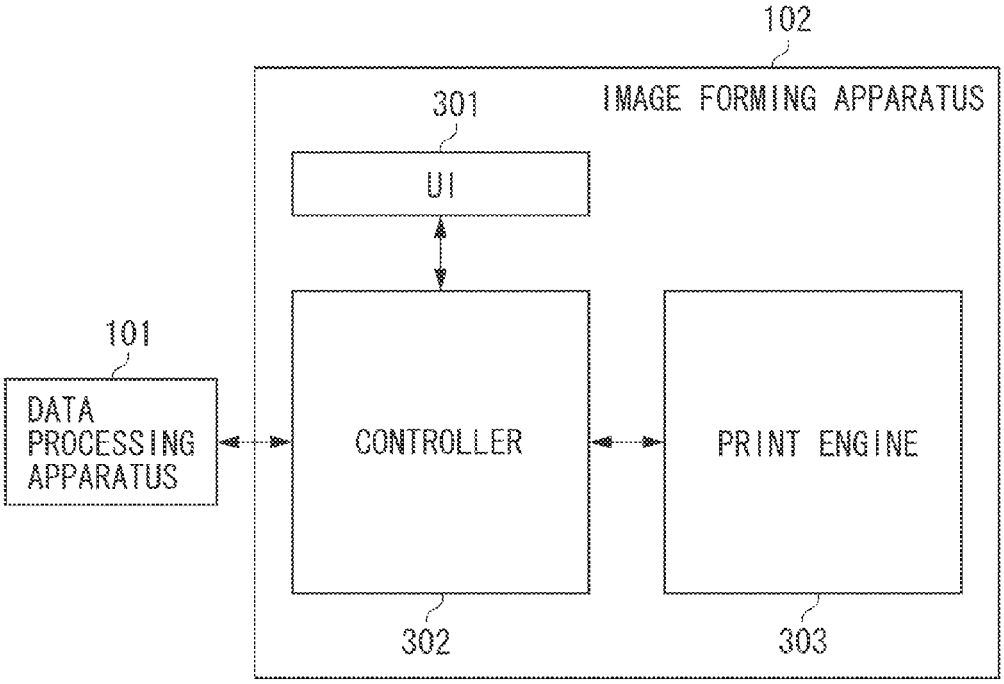
FIG. 1 is a block diagram illustrating a configuration of an image forming apparatus.

FIG. 1 is a block diagram illustrating a configuration of an image forming apparatus.

A data processing apparatus 101 (a personal computer (PC), for example) generates image data and transmits the image data to an image forming apparatus 102.

The image forming apparatus 102 (a laser printer, for example) receives image data from the data processing apparatus 101 and forms an image on a sheet based on the image data. The image forming apparatus 102 may be a multifunction peripheral with a scanner function and/or a facsimile (FAX) function.

A user interface (UI) 301 is an interface including a display unit for providing a user with various pieces of information and an operation unit for receiving various operations from the user. The display unit displays a current value of a toner remaining amount described below. The current value of the toner remaining amount may be transmitted to an external apparatus such as the data processing apparatus 101 via an external interface (I/F) and displayed on a display unit of the external apparatus such as the data processing apparatus 101.

A controller 302 generates bit map data based on page description language (PDL) data and transmits the bit map data to a print engine 303. The controller 302 is described in detail below with reference to FIG. 2.

The print engine 303 forms an image on a sheet using a toner with an electrophotographic method based on the bit map data received from the controller 302. An image may be formed by an ink-jet method, for example, instead of the electrophotographic method. A recording material for the electrophotographic method is toner, while one for the ink-jet method is ink.

The controller 302 is separate from the print engine 303, however, both may be integrated with each other.

Figure 2:
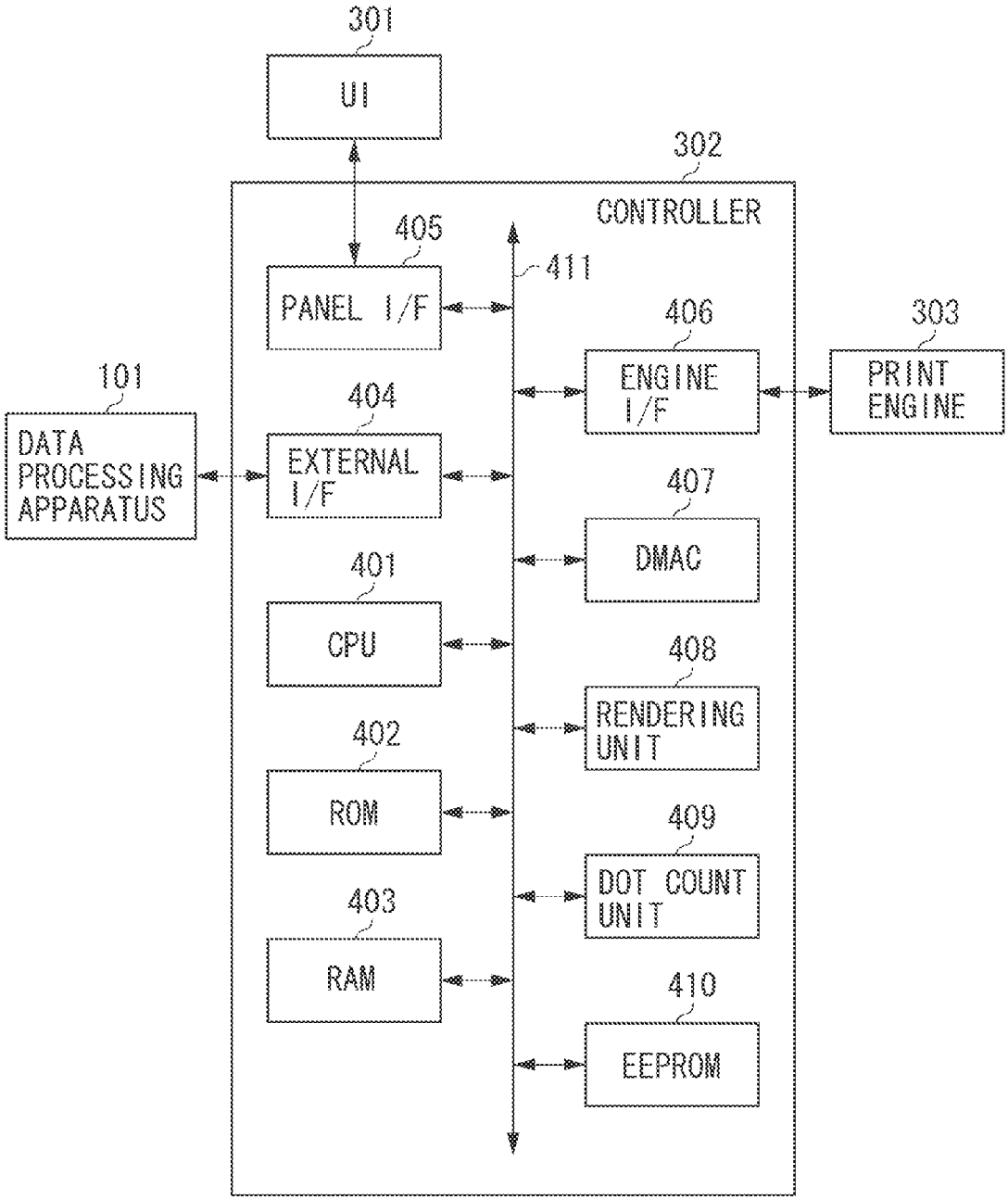
FIG. 2 is a block diagram illustrating a configuration of a controller.

FIG. 2 is a block diagram illustrating a configuration of a controller.

A central processing unit (CPU) 401 loads a program stored in a read only memory (ROM) 402 into a random access memory (RAM) 403 and executes the program to control the image forming apparatus 102. As described below, the CPU 401 calculates a toner remaining amount based on a predicted value of a toner consumption amount converted from a dot count counted by a dot count unit 409 or a sensor value of the toner remaining amount sent from the print engine 303. The CPU 401 displays the calculated toner remaining amount on the UI 301 via a panel I/F 405 or notifies the data processing apparatus 101 of the toner remaining amount via an external I/F 404.

The ROM 402 stores programs executed by the CPU 401.

The RAM 403 stores programs loaded from the ROM 402. The RAM 403 also stores the PDL data, intermediate data generated by interpreting the PDL data, bit map data generated by rendering the intermediate data, temporal various processing statuses required for other processing, and log information.

The external I/F 404 connects the data processing apparatus 101 with the controller 302 and relays data communication, that is, transmission and reception of data between them.

The panel I/F 405 connects the UI 301 with the controller 302 and relays data communication, that is, transmission and reception of data between them.

An engine I/F 406 connects the print engine 303 with the controller 302 and relays data communication, that is, transmission and reception of data between them.

A direct memory access controller (DMAC) 407 receives a command from the CPU 401 and performs data access, that is, writes data into and reads data from the RAM 403.

A rendering unit 408 expands the intermediate data into bit map data.

The dot count unit 409 counts the number of dots consuming toner in image formation among the expanded dots included in the bit map data. More specifically, the number of dots of colors except white is counted. For example, in a case of monochrome print, the number of dots corresponding to K (black) is counted. In a case of color print, the number of dots corresponding to any of Y (yellow), M (magenta), C (cyan), and K (black) is counted. The number of dots may be counted by the CPU 401 or the rendering unit 408.

An electrically erasable, programmable read-only memory (EEPROM) 410 stores setting information on the image forming apparatus 102.

A bus 411 mutually connects each unit in the controller 302.

Figure 3:
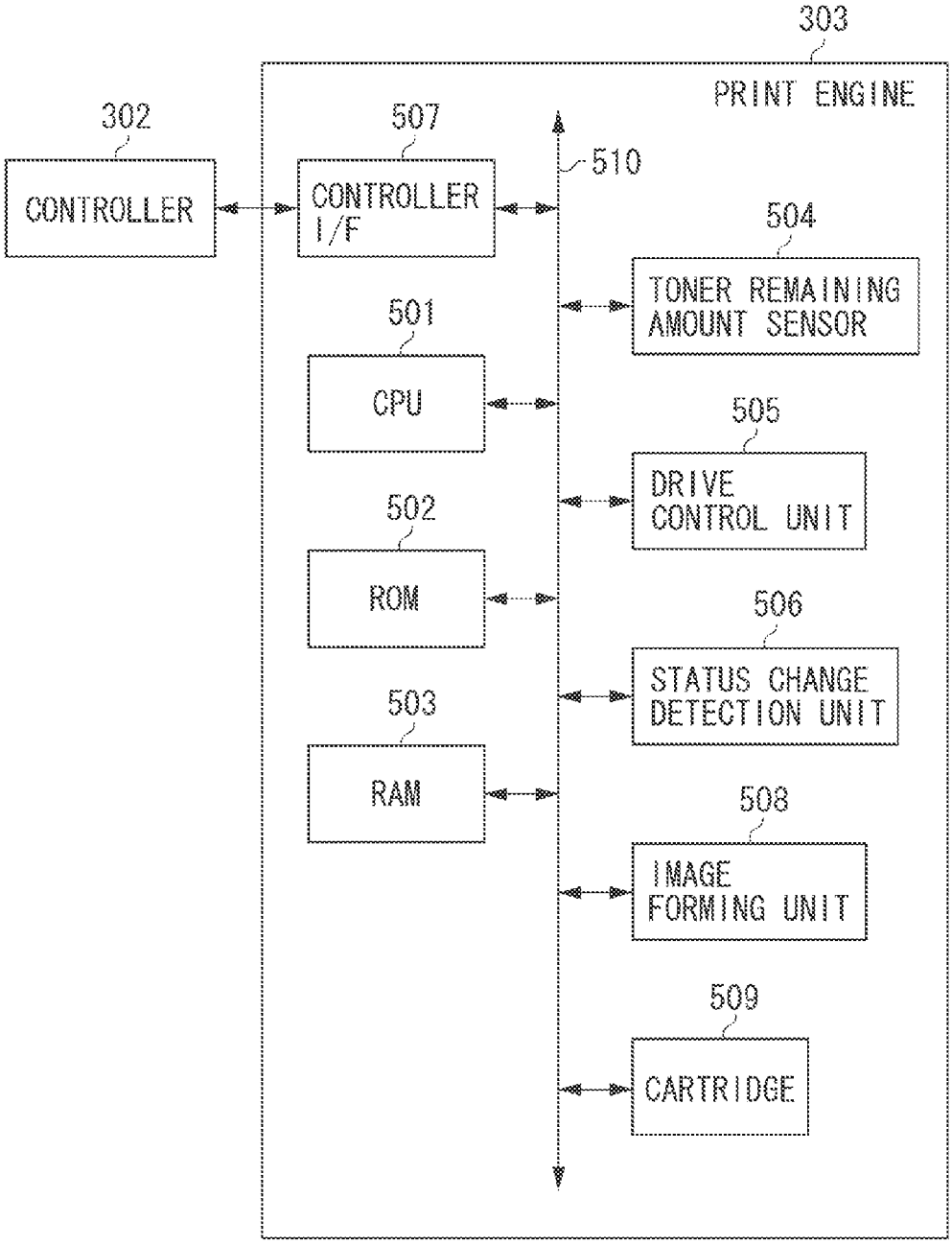
FIG. 3 is a block diagram illustrating a configuration of a print engine.

FIG. 3 is a block diagram illustrating a configuration of the print engine.

A CPU 501 loads a program stored in a ROM 502 into a RAM 503 and executes the program to control the print engine 303.

The ROM 502 stores programs executed by the CPU 501.

The RAM 503 stores programs loaded from the ROM 502.

A toner remaining amount sensor 504 measures a toner remaining amount included in a cartridge 509. Methods of detecting the toner remaining amount in a sensor include a magnetic permeability detection method, a magnet method, a piezoelectric vibration method, and a transmitted light method, for example. When the toner remaining amount reaches a predetermined value of 20% or 0%, for example, the sensor detects the value as a sensor value. More specifically, if the toner remaining amount is 100% to 21%, the sensor detects the value as 100%. If the toner remaining amount is 20% to 1%, the sensor detects the value as 20%. If the toner remaining amount is 0%, the sensor detects the value as 0%. The sensor may be provided in the cartridge 509.

A drive control unit 505 drives various motors required when an image forming unit 508 forms an image.

A status change detection unit 506 detects change in status such as a jam, cover opening, or the like in the image forming apparatus. The status change detection unit 506 also detects the replacement of the cartridge 509. Change in status may be detected by the CPU 501.

A controller I/F 507 connects the controller 302 with the print engine 303 and relays data communication, that is, transmission and reception of data between them.

The image forming unit 508 forms an image on a sheet using a toner by the electrophotographic method based on the bit map data received from the controller 302.

The cartridge 509 is a process cartridge which can be attached to the image forming apparatus 102 as a storage unit for containing toner and stores toner used when the image forming unit 508 forms an image. The cartridge 509 has a nonvolatile storage medium, and cartridge information is stored therein. The cartridge information includes information as to whether a cartridge is new, color information indicating color of the cartridge, and information about a current toner remaining amount in the cartridge. The cartridge 509 is connected to a bus 510, but, may be connected with the CPU 501 via a leased line.

The bus 510 mutually connects each configuration in the print engine 303.

Figure 4:
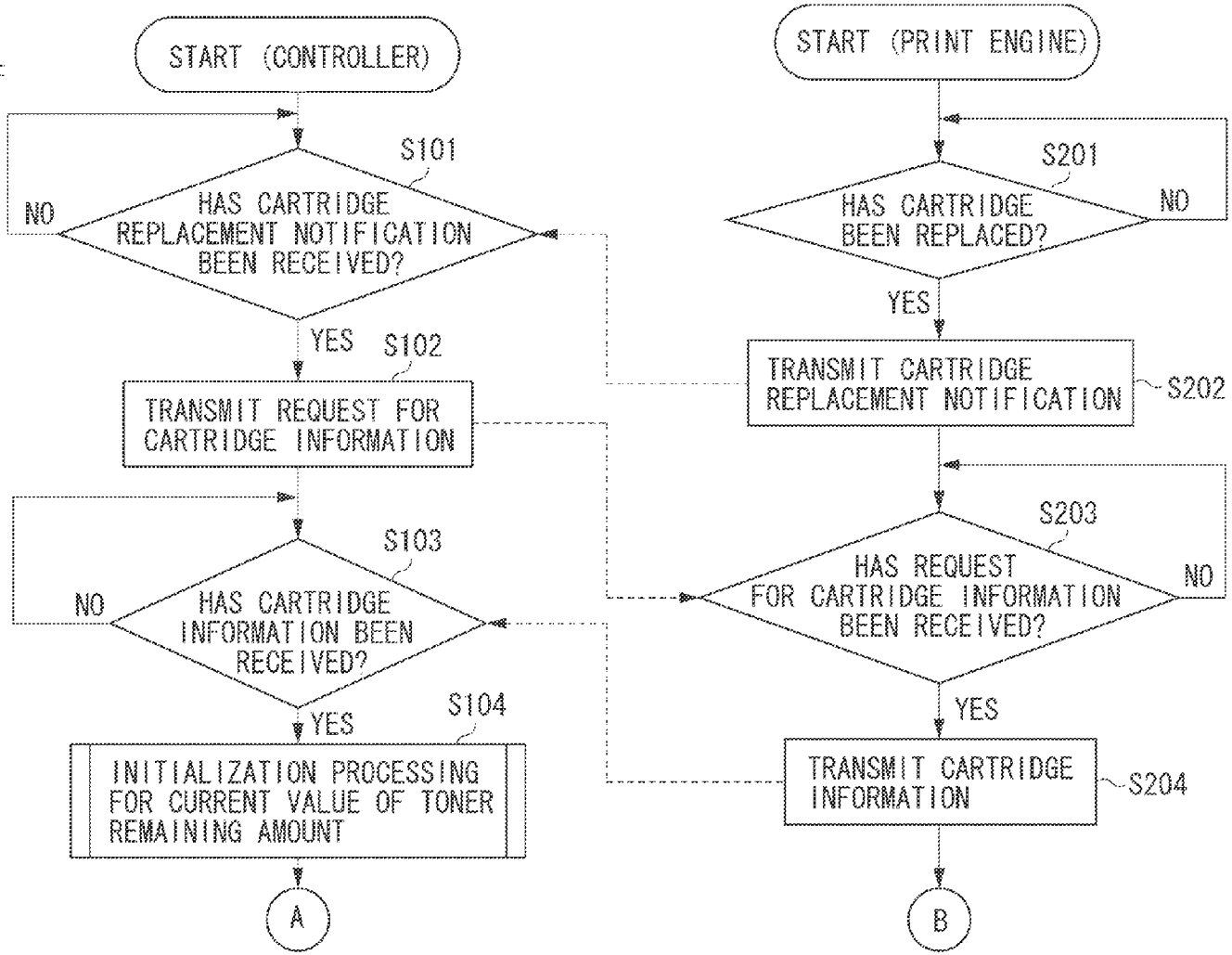
FIG. 4 is a flowchart illustrating control for detecting a toner remaining amount (first half).
Figures 5, 5A:
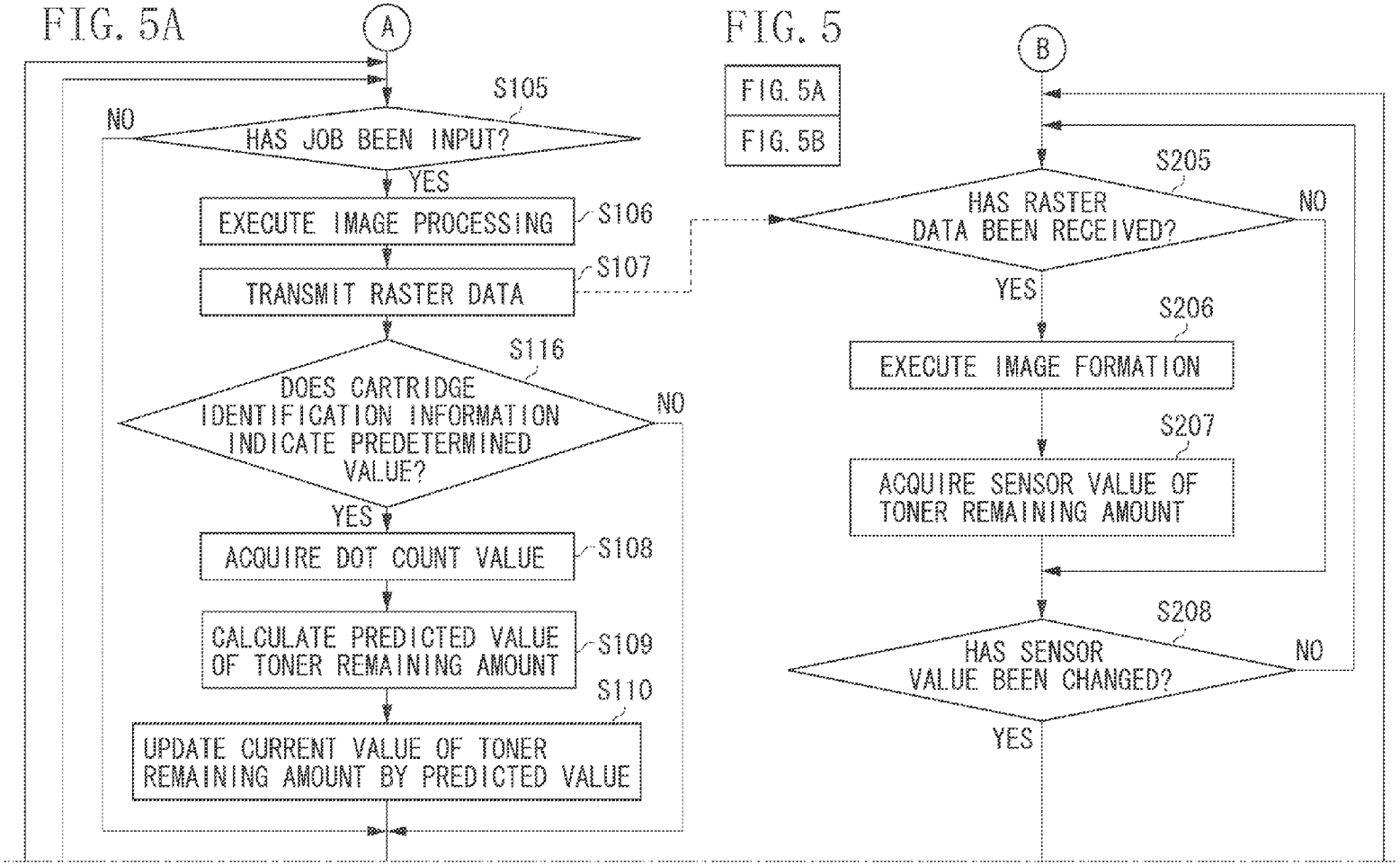
FIG. 5, composed of FIG. 5A and FIG. 5B, is a flowchart illustrating the control for detecting the toner remaining amount (second half).
Figure 5B:
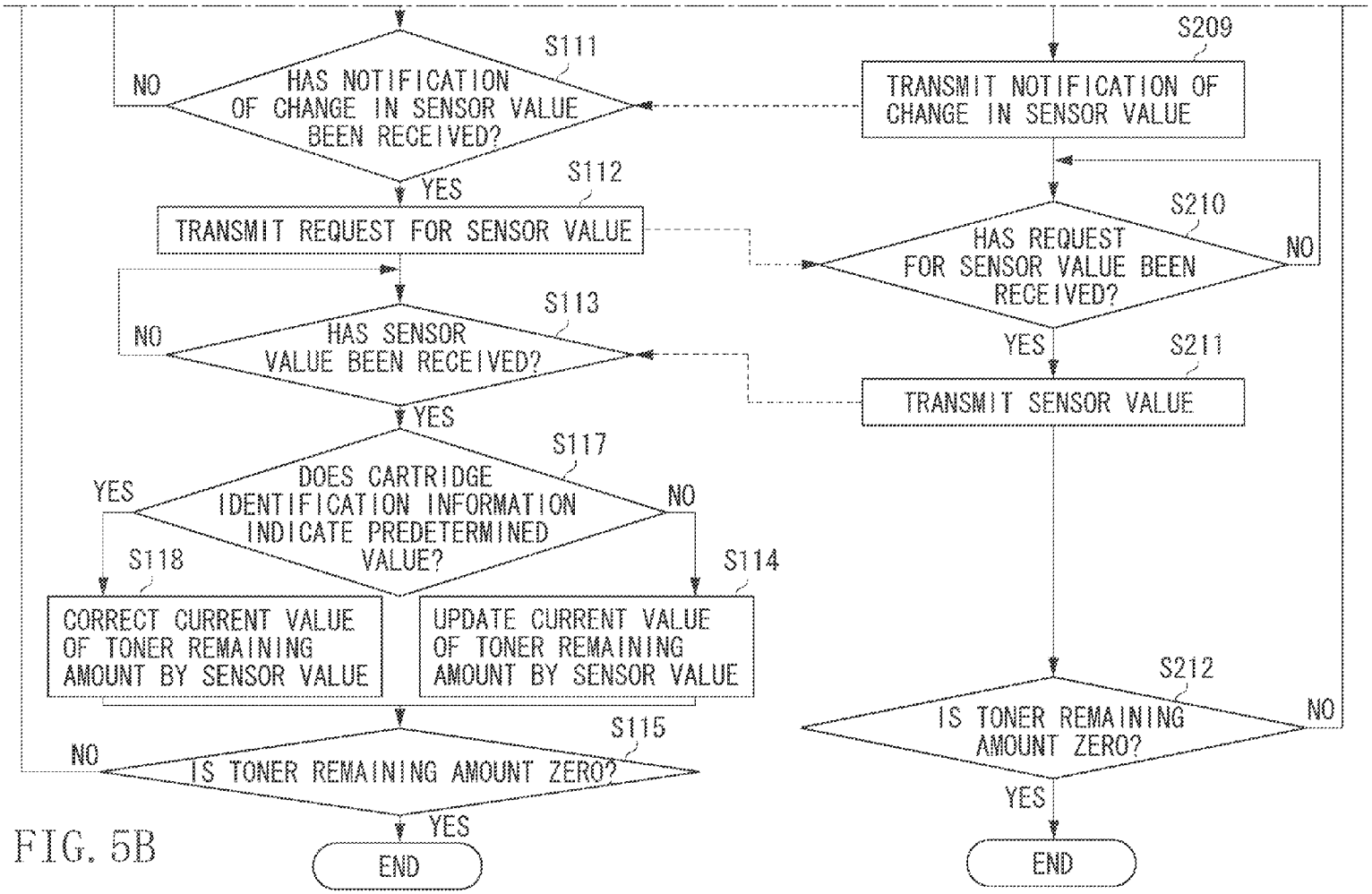

FIGS. 4 and 5 are flowcharts illustrating the control for detecting a toner remaining amount.

Control illustrated in a left flowchart is realized by the CPU 401 loading the control program stored in the ROM 402 into the RAM 403 and executing the program in the controller 302. Control illustrated in a right flowchart is realized by the CPU 501 loading the control program stored in the ROM 502 into the RAM 503 and executing the program in the print engine 303.

In step S201, the CPU 501 determines whether the cartridge 509 has been replaced. This is determined by detecting that the cartridge 509 is newly attached to the image forming apparatus 102. The attachment of the cartridge 509 to the image forming apparatus 102 is recognized by the status change detection unit 506 detecting that the cartridge 509 is attached thereto and notifying the CPU 501 of the attachment. The attachment of the cartridge 509 may be detected by opening and closing a cover provided for replacing the cartridge 509, or by a button or a switch changing its on/off state in a hardware manner according to the attachment and detachment of a component. If the cartridge 509 has been replaced (YES in step S201), the processing proceeds to step S202. If the cartridge 509 has not been replaced (NO in step S201), the processing is on standby.

In step S202, the CPU 501 notifies the controller 302 that the cartridge 509 has been replaced via the controller I/F 507.

In step S101, the CPU 401 determines whether to have received a cartridge replacement notification from the print engine 303 via the engine I/F 406. If the CPU 401 has received the notification (YES in step S101), the processing proceeds to step S102. If the CPU 401 has not received the notification (NO in step S101), the processing is on standby.

In step S102, the CPU401 transmits a request for cartridge information about the cartridge 509 to the print engine 303 via the engine I/F 406. The cartridge information is described in detail below with reference to FIG. 7.

In step S203, the CPU 501 determines whether to have received the request for cartridge information from the controller 302 via the controller I/F 507. If the CPU 501 has received the request (YES in step S203), the processing proceeds to step S204. If the CPU 501 has not received the request (NO in step S203), the processing is on standby.

In S204, the CPU 501 transmits the cartridge information about the cartridge 509 to the controller 302 via the controller I/F 507.

In step S103, the CPU 401 determines whether to have received the cartridge information from the print engine 303 via the engine I/F 406. If the CPU 401 has received the information (YES in step S103), the processing proceeds to step S104. If the CPU 401 has not received the information (NO in step S103), the processing is on standby.

In step S104, the CPU 401 initializes the current value of the toner remaining amount. Such processing is described in detail below with reference to FIG. 6. The current value of the toner remaining amount refers to a value recognized by the controller 302 as the toner remaining amount of the cartridge 509 and a value displayed to a user via the UI 301. The current value of the toner remaining amount is stored in the RAM 403.

In step S105, the CPU 401 determines whether a job to be executed for forming an image has been input from the data processing apparatus 101 via the external I/F 404. Examples of the job include a PDL print job, a copy job, and a FAX reception print job. If the job has been input (YES in step S105), the processing proceeds to step S106. If the job has not been input (NO in step S105), the processing proceeds to step S111.

In step S106, the CPU 401 executes image processing required for forming an image based on the job. The image processing includes processing for controlling the rendering unit 408 to expand print data into raster data.

In step S107, the CPU 401 transmits raster data generated by the image processing to the print engine 303 via the engine I/F 406.

Figure 7:
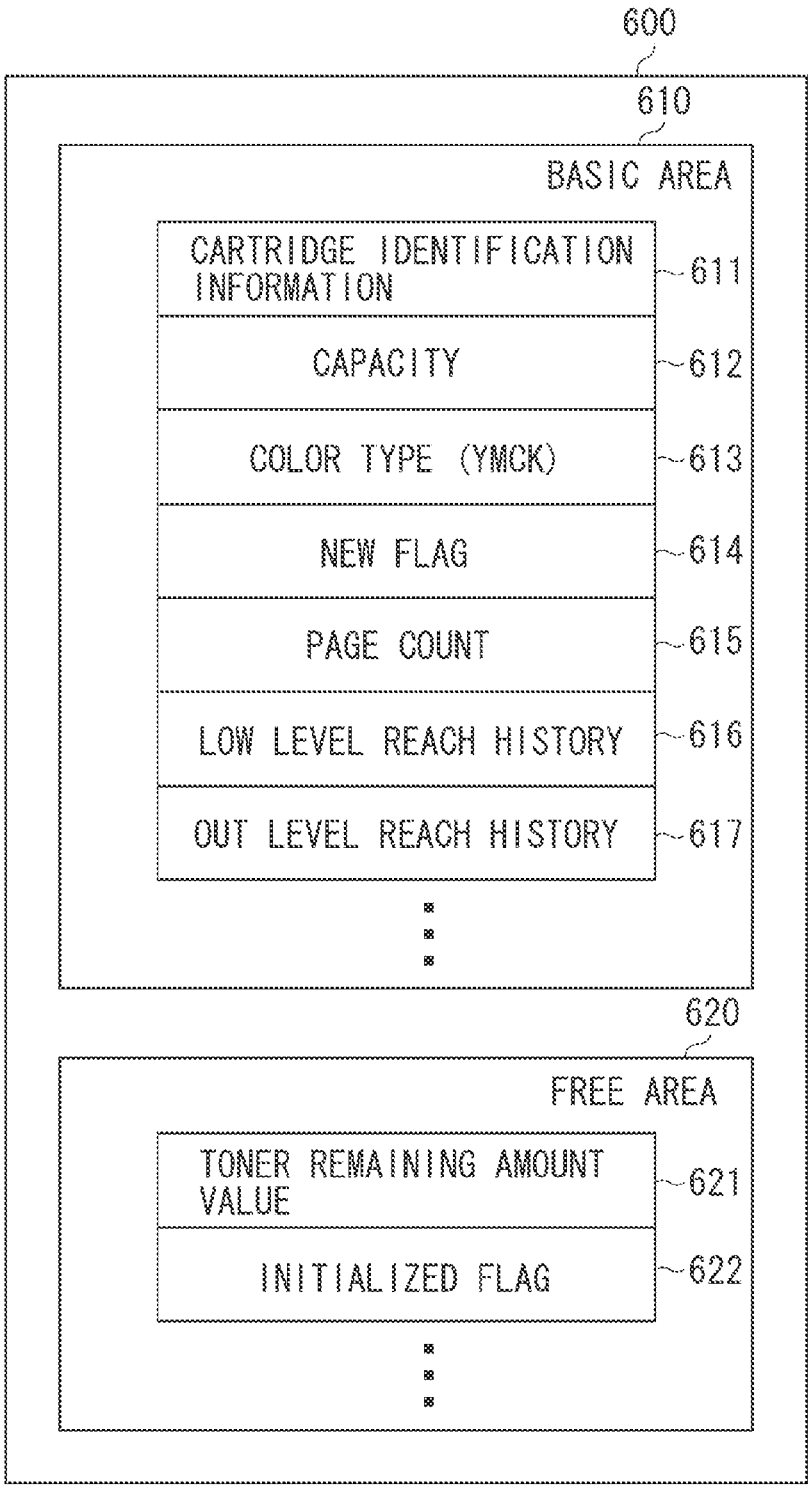
FIG. 7 is a chart illustrating a data configuration of a memory tag.

In step S116, the CPU 401 determines whether the cartridge information acquired in step S103 indicates a predetermined value. Whether the cartridge information indicates the predetermined value is recognized by the fact whether cartridge identification information (611) described in FIG. 7 is a predetermined value, for example, a specific character string like "canon". A method for determination in step S116 may use the fact whether a cartridge is in an abnormal state based on a page count (615) and an out level reach history (617) described below in FIG. 7. If it is determined that the cartridge information indicates no predetermined value (NO in step S116), it is desirable to display such determination result on the UI 301, for example. If the cartridge information indicates the predetermined value (YES in step S116), the processing proceeds to step S108. If the cartridge information indicates no predetermined value (NO in step S116), the processing proceeds to step S111.

If it is determined that the cartridge information indicates a predetermined value (YES in step S116), a toner consumption amount for each dot in case of using the toner cartridge is specified beforehand as a predicted value of high accuracy through experiment, and is stored in the ROM 402. Accordingly, if it is determined that the cartridge information indicates a predetermined value (YES in step S116), a toner remaining amount of high accuracy can be predicted. On the other hand, if it is determined that the cartridge information indicates no predetermined value (NO in step S116), a toner consumption amount for each dot in case of using the toner cartridge is not specified as a predicted value of high accuracy. Accordingly, in the present embodiment, if it is determined that the cartridge information indicates no predetermined value (NO in step S116), no prediction of a toner remaining amount based on a dot count value is performed.

In step S108, the CPU 401 acquires a dot count value measured in generating the raster data from the dot count unit 409. The dot count value may be acquired in units of pages or in units of jobs.

In step S109, the CPU 401 calculates a predicted value of the toner remaining amount based on the dot count value acquired in step S108. More specifically, first, calculation is made by using the following equation: (the dot count value [dot] at the time of printing a present job or page)×(a toner consumption amount for each dot [g/dot])=(a toner consumption amount [g] due to the present job execution). The toner consumption amount for each dot may be previously stored in the ROM 402 or included in the cartridge information received in step S103. Next, calculation is made by using the following equation: (a current toner remaining amount [g])−(the toner consumption amount [g] due to the present job execution)=(a new toner remaining amount [g]). Then, calculation is made by using the following equation: (the new toner remaining amount [g])/a toner remaining amount [g] acquired when the cartridge is not used)=(a predicted value [%] of the new toner remaining amount). The toner remaining amount [g] acquired when the cartridge is not used may be previously stored in the ROM 402 or included in the cartridge information received in step S103.

In step S110, the CPU 401 updates the current value of the toner remaining amount by the predicted value calculated in step S109.

In step S205, the CPU 501 determines whether to have received the raster data from the controller 302 via the controller I/F 507. If the CPU 501 has received the raster data (YES in step S205), the processing proceeds to step S206. If the CPU 501 has not received the raster data (NO in step S205), the processing proceeds to step S208.

In step S206, the CPU 501 controls the image forming unit 508 to execute image formation based on the raster data.

In step S207, the CPU 501 acquires the sensor value of the toner remaining amount. The sensor value may be acquired in units of pages or in units of jobs when an image formation is completed. Alternatively, the sensor value may be acquired each time a predetermined time elapses.

In step S208, the CPU 501 determines whether the sensor value acquired at present has been changed from that acquired last time. If the sensor value has been changed (YES in step S208), the processing proceeds to step S209. If the sensor value has not been changed (NO in step S208), the processing returns to step S205.

In step S209, the CPU 501 transmits to the controller 302 via the controller I/F 507 a notification of change in a sensor value indicating that the sensor value has been changed.

In step S111, the CPU 401 determines whether the notification of change in the sensor value has been received from the print engine 303 via the engine I/F 406. If the notification has been received (YES in step S111), the processing proceeds to step S112. If the notification has not been received (NO in step S111), the processing returns to step S105.

In step S112, the CPU 401 transmits a request for the sensor value to the print engine 303 via the engine I/F 406.

In step S210, the CPU 501 determines whether to have received the request for the sensor value from the controller 302 via the controller I/F 507. If the CPU 501 has received the request (YES in step S210), the processing proceeds to step S211. If the CPU 501 has not received the request (NO in step S210), the processing is on standby.

In step S211, the CPU 501 transmits the sensor value to the controller 302 via the controller I/F 507.

In step S113, the CPU 401 determines whether to have received the sensor value from the print engine 303 via the engine I/F 406. If the CPU 401 has received the sensor value (YES in step S113), the processing proceeds to step S117. If the CPU 401 has not received the sensor value (NO in step S113), the processing is on standby.

In step S117, similarly to step S116, the CPU 401 determines whether the cartridge information acquired in step S103 indicates a predetermined value. If the cartridge information indicates the predetermined value (YES in step S117), the processing proceeds to step S118. If the cartridge information indicates no predetermined value (NO in step S117), the processing proceeds to step S114.

In step S118, the CPU 401 corrects the current value based on the sensor value acquired in step S113. The current value may be corrected, for example, in such a manner that, if the sensor value is smaller than the current value, the sensor value may be simply taken as the current value, or the current value may be corrected by calculation based on the degree of deviation between the sensor value and the current value.

In step S114, the CPU 401 updates the current value by the sensor value acquired in step S113.

In step S115, the CPU 401 determines whether the toner remaining amount is reduced to zero with reference to the current value of the toner remaining amount. If the toner remaining amount is reduced to zero (YES in step S115), the processing ends. If the toner remaining amount is not reduced to zero (NO in step S115), the processing returns to step S105.

In step S212, the CPU 501 determines whether the toner remaining amount is reduced to zero with reference to the sensor value of the toner remaining amount. If the toner remaining amount is reduced to zero (YES in step 212), the processing ends. If the toner remaining amount is not reduced to zero (NO in step 212), the processing returns to step S205.

Figure 6:
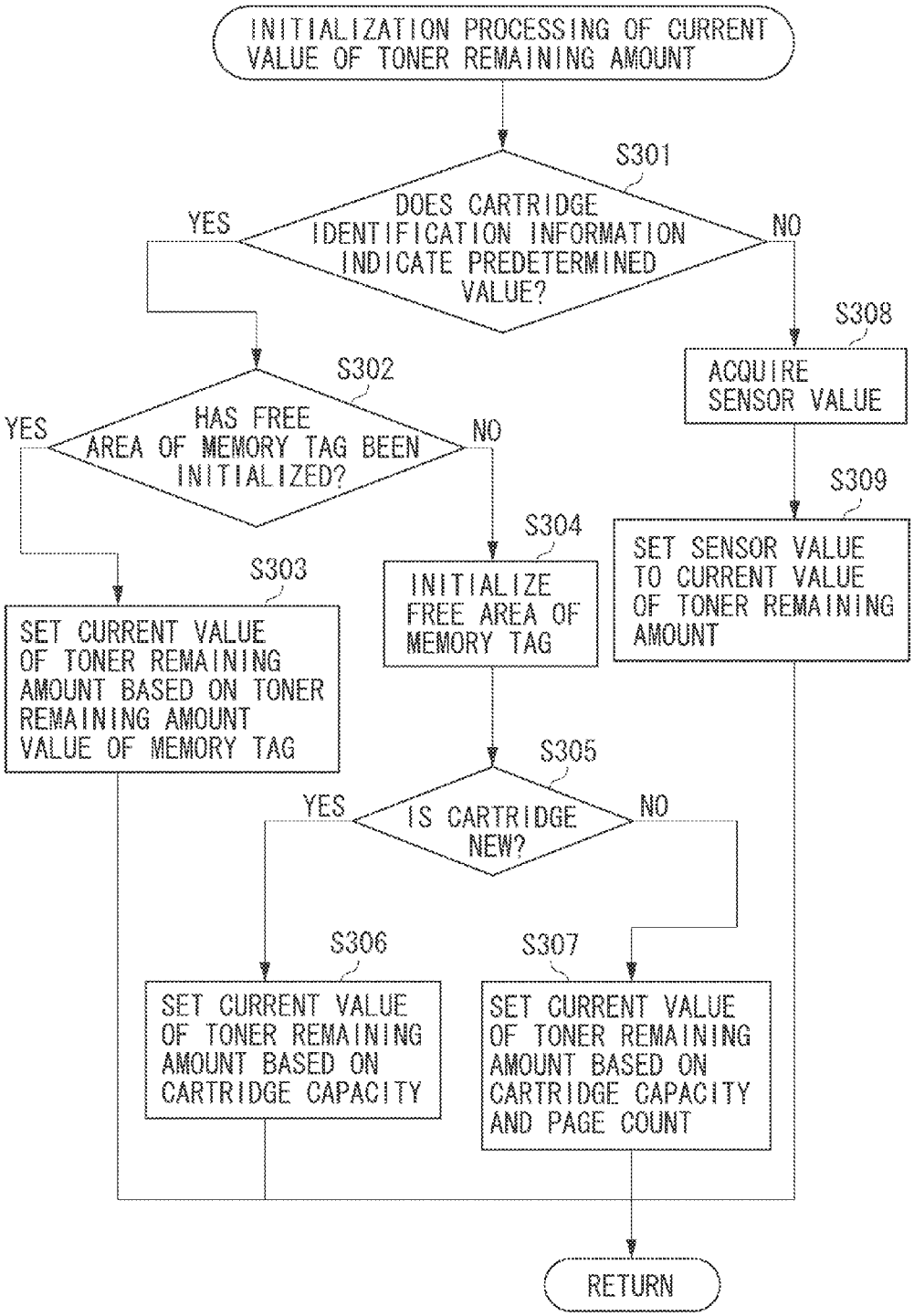
FIG. 6 is a flowchart illustrating in detail initialization processing of a current value of the toner remaining amount.

FIG. 6 is a flowchart illustrating in detail initialization processing of a current value of the toner remaining amount.

In step S301, similarly to step S116 described above, the CPU 401 determines whether the cartridge information acquired in step S103 indicates a predetermined value. If the cartridge information indicates the predetermined value (YES in step S301), the processing proceeds to step S302. If the cartridge information indicates no predetermined value (NO in step S301), the processing proceeds to step S308.

In step S302, the CPU 401 determines whether a free area of a memory tag has been initialized. A determination as to whether the free area has been initialized can be made using a method for confirming an initialized flag (622) illustrated in FIG. 7 described below. If the free area has been initialized (YES in step S302), the processing proceeds to step S303. If the free area has not been initialized (NO in step S302), the processing proceeds to step S304.

In step S303, the CPU 401 sets a toner remaining amount value (621) as the current value.

On the other hand, in step S304, the CPU 401 initializes the free area of the memory tag. In the initialization, zero is set to the toner remaining amount value (621) or an initialized flag is set.

In step S305, the CPU 401 determines whether a cartridge is brand-new. If the cartridge is brand-new (YES in step S305), the processing proceeds to step S306. If the cartridge is not brand-new (NO in step S305), the processing proceeds to step S307.

In step S306, the CPU 401 sets the current value based on a cartridge capacity (612).

On the other hand, in step S307, the CPU 401 sets the current value based on the cartridge capacity (612) and the page count (615).

In step S308, the CPU 401 acquires the sensor value similarly to steps S112 and S113 described above.

In step S309 the CPU 401 sets the sensor value acquired in step S308 as the current value of the toner remaining amount.

FIG. 7 is a chart illustrating a data configuration of the memory tag. The memory tag denotes a nonvolatile storage medium incorporated in the cartridge 509.

An entire data area 600 includes a basic area 610 and a free area 620.

The basic area 610 includes the cartridge identification information 611, a capacity 612, a color type (YMCK) 613, a new flag 614, a page count 615, a low level reach history 616, and an out level reach history 617. Those are referred to as cartridge information.

The cartridge identification information 611 indicates a type or a manufacturer of the cartridge 509.

The capacity 612 indicates the capacity of toner which can be stored in the cartridge 509.

The color type (YMCK) 613 indicates the color of the toner stored in the cartridge 509.

The new flag 614 signifies whether a toner cartridge is brand new.

The page count 615 represents the number of pages printed using the cartridge 509.

The low level reach history 616 indicates as to whether the toner remaining amount of the cartridge 509 reaches a low level (20%). The low level is a value indicating that the remaining amount of a recording material becomes small. The value may be 10% or 15%, for example, instead of 20%.

The out level reach history 617 indicates as to whether the toner remaining amount of the cartridge 509 reaches an out level (0%). The out level is a value indicating that the remaining amount of the recording material is reduced to zero. The value may be 1% to 3%, for example, instead of 0%.

The free area 620 includes the toner remaining amount value 621. New information can be added to or be changed in the free area 620 according to a request of the CPU 501.

The toner remaining amount value 621 indicates the toner remaining amount (%) of the cartridge 509. The toner remaining amount may be stored in [g].

The initialized flag 622 indicates whether the free area of the memory tag is initialized.

According to a first exemplary embodiment described above, if a predicted value of the toner remaining amount can be calculated from a state of a cartridge, a calculated predicted value in addition to a sensor value is used to determine a current value to be displayed, which allows accuracy to be improved in the display of the toner remaining amount.

According to the first exemplary embodiment, the toner remaining amount is displayed on the printer side.

According to a second exemplary embodiment, on the other hand, the toner remaining amount is displayed on the host computer side.

More specifically, the CPU of the data processing apparatus 101 acquires the current value of the toner remaining amount from the image forming apparatus 102 at a predetermined timing (after a job is completed or a predetermined time elapses). The CPU of the data processing apparatus 101 displays the current value on the display of the data processing apparatus.

According to the second exemplary embodiment, the toner remaining amount can be confirmed on the host computer side to improve user-friendliness.

According to the second exemplary embodiment, the toner remaining amount is displayed on the host computer side.

In addition, according to a third exemplary embodiment, the toner remaining amount is calculated on the host computer side as well. The present exemplary embodiment is particularly effective in a print system of a host base system (in which expansion processing of image data is performed on the host computer side).

More specifically, the CPU of the data processing apparatus 101 acquires the sensor value and the cartridge information from the image forming apparatus 102 at a predetermined timing (after a job is completed or a predetermined time elapses). The CPU of the data processing apparatus 101 performs processing on the controller side illustrated in FIGS. 4 and 5 using those pieces of information. The CPU of the data processing apparatus 101 displays the current value on the display of the data processing apparatus.

According to the third exemplary embodiment, the toner remaining amount is calculated on the host computer side to allow reducing a processing load on the printer side.

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-180001 filed Aug. 30, 2013, which is hereby incorporated by reference herein in its entirety.

What is claimed is:

1. An image forming apparatus for executing printing on a sheet using a recording material, comprising:

a prediction unit configured to predict a remaining amount of the recording material based on a dot count value;

an acquisition unit configured to acquire a remaining amount of the recording material which is identified by a remaining-amount sensor;

a notification unit configured to notify a user of a remaining amount of the recording material;

a determining unit configured to determine whether or not a storage unit for storing the recording material is a predetermined type of storage unit; and a control unit configured to control the notification unit to notify a user of a remaining amount of the recording material using both of the remaining amount predicted by the prediction unit and the remaining amount acquired by the acquisition unit in a case where the determining unit determines that the storage unit is the predetermined type of storage unit, and control the notification unit to notify a user of a remaining amount of the recording material using the remaining amount acquired by the acquisition unit without using the remaining amount predicted by the prediction unit in a case where the determining unit determines that the storage unit is not the predetermined type of storage unit.

2. The image forming apparatus according to claim 1, wherein the recoding material is a toner and the storage unit is a cartridge.

3. The image forming apparatus according to claim 1, wherein the notification unit displays a remaining amount of the recording material.

4. The image forming apparatus according to claim 1, wherein the determining unit determines that the storage unit is the predetermined type of storage unit, in a case where predetermined identification information is stored in a memory of the storage unit, and the determining unit determines that the storage unit is not the predetermined type of storage unit, in a case where predetermined identification information is not stored in the memory of the storage unit.

5. A method for controlling an image forming apparatus for executing printing on a sheet using a recording material, the method comprising:

predicting a remaining amount of the recording material based on a dot count value;

acquiring a remaining amount of the recording material which is identified by a remaining-amount sensor;

notifying a user of a remaining amount of the recording material;

determining whether or not a storage unit for storing the recording material is a predetermined type of storage unit; and notifying a user of a remaining amount of the recording material using both the remaining amount predicted and the remaining amount acquired, in a case where it is determined that the storage unit is the predetermined type of storage unit; and notifying the user of a remaining amount of the recording material using the remaining amount acquired without using the remaining amount predicted, in a case where it is determined that the storage unit is not the predetermined type of storage unit.

6. A non-transitory computer-readable storage medium for storing a program for causing an image forming apparatus for executing printing on a sheet to perform a method comprising:

predicting a remaining amount of the recording material based on a dot count value;

acquiring a remaining amount of the recording material which is identified by a remaining-amount sensor;

notifying a user of a remaining amount of the recording material;

determining whether or not a storage unit for storing the recording material is a predetermined type of storage unit; and notifying a user of a remaining amount of the recording material using both the remaining amount predicted and the remaining amount acquired, in a case where it is determined that the storage unit is the predetermined type of storage unit; and notifying the user of a remaining amount of the recording material using the remaining amount acquired without using the remaining amount predicted, in a case where it is determined that the storage unit is not the predetermined type of storage unit.

* * * * *